United States Patent [19]

Hudec

[11] Patent Number: 4,759,542

[45] Date of Patent: Jul. 26, 1988

[54] BODY BALANCE BOARD AND METHOD OF EXERCISE THEREFOR

[76] Inventor: Donald P. Hudec, 5601 Manzanita Ave., Carmichael, Calif. 95608

[21] Appl. No.: 825,550

[22] Filed: Feb. 3, 1986

[51] Int. Cl.[4] ..... A63B 23/04; A63B 69/00

[52] U.S. Cl. ..... 272/111; 272/146

[58] Field of Search ..... 272/96, 97, 111, 93, 272/146, 54–56; 128/57

[56] References Cited

U.S. PATENT DOCUMENTS

| | | | |
|---|---|---|---|
| 3,361,427 | 1/1968 | Paves | 272/96 |
| 3,488,049 | 1/1970 | Sasser, Jr. | 272/111 |
| 3,589,716 | 6/1971 | Footlik | 272/111 |
| 3,761,084 | 9/1973 | Dieckmann | 272/146 |
| 3,895,794 | 7/1975 | England | 272/111 |
| 4,191,371 | 3/1980 | Armer, Jr. | 272/111 |
| 4,601,469 | 7/1986 | Sasser, Jr. | 272/111 |
| 4,635,932 | 1/1987 | Dewees | 272/96 |

FOREIGN PATENT DOCUMENTS

| | | | |
|---|---|---|---|
| 2510895 | 2/1983 | France | 272/146 |
| 2093708 | 9/1982 | United Kingdom | 272/146 |

*Primary Examiner*—Richard J. Apley
*Assistant Examiner*—S. R. Crow
*Attorney, Agent, or Firm*—Leonard Bloom

[57] ABSTRACT

A device and method for concomitently correlating cerebral, neural and muscular reflexes by rocking on an upper portion having a top surface dimensioned to address and receive the planar portion of a person's foot having a fulcrum coacting against a bottom surface of the upper portion along a central area thereof, to allow a rocking motion of upper portion about the fulcrum and a pivot to variably orient the fulcrum with respect to the upper portion to vary the axis of rotation. A lower portion is also provided to vary the range of rocking.

16 Claims, 1 Drawing Sheet

BODY BALANCE BOARD AND METHOD OF EXERCISE THEREFOR

FIELD OF THE INVENTION

The following invention relates generally to instrumentalities for exercising, therapy and sharpening the balancing acuity of the user.

BACKGROUND OF THE INVENTION

Controversies continue with respect to the best mode of exercise. Cardiovascular exercises, muscle toning, weight lifting, jogging, swimming, and aerobics all have their devotees, and in fact within each discipline various theories abound with respect to the most effective techniques.

One area which should receive greater attention is the balancing system of the body. Since standing is a postural reflex with various muscles relaxing and contracting to maintain an erect posture, the body and brain's system for accommodating postural imbalance is so automatic that it almost goes unnoticed. When the body is placed off balance, however, the relay stations in the brain are signaled by the inner ear and send an immediate demand to the entire nervous system calling for the appropriate muscles to contract or relax in reciprocation in order to regain balance.

The essence of this invention takes advantage of the almost reflexive accommodation which the brain and nervous system play in maintaining balance by formulating an exercise device which tends to exaggerate off balance conditions in a controlled manner to concomitantly hone the balancing reflexes intrinsic in all people. As an additional intended benefit, this balancing accommodation provides a form of exercise.

Prior art devices are known to exist which, in some mode or another, rely on the intrinsic balancing ability of the exercise user. For example, the U.S. Pat. No. 3,361,427, Paves, is an example of an exercise rocker in which a supporting platform is adapted to receive both feet of the exerciser and a surface remote therefrom includes an underlying rib allowing rocking both in the direction of the longitudinal axis of the feet and transverse thereto.

The patents of England, U.S. Pat. No. 3,895,794, Armer Jr., U.S. Pat. No. 4,191,371 and Dieckmann, U.S. Pat. No. 3,761,084 all rely on balancing upon an underlying support member formed as an arc of a circle, such as a log or ball.

SUMMARY AND OBJECTS OF THE INVENTION

The instant invention is distinguished over the known prior art in that an instrumentality has been provided which allows a single foot of the exerciser to be pivoted at a time and in a controlled manner with the defined axis of rotation variable as a function of the reflexive muscle response desired. In addition, the exercise is quantified to allow people at a lowest spectrum of physical skills (such as those who are convelescing, disabled or geriatric) to begin a balancing and exercise technique at a level where they can safely perform.

More specifically, an instrumentality has been provided which is defined by two components, the first component formed as a single foot engaging area having a bottom surface provided with an axis of rotation means which is adapted to pivot through a range of 360°, and a second component which can be placed adjacent to the axis of rotation or at a distal end of the foot supporting surface to limit the amount of rotation about the axis of rotation by appropriate orientation of the second component.

Accordingly, this invention has as its objective, the provision of a new and novel exercise, therapy and balancing device.

It is the further object of this invention to provide a device as characterized above which is relatively inexpensive to manufacture, extremely durable in construction, and lends itself to mass production techniques.

A further object of this invention contemplates providing a device as characterized above which provides various gradations of exercise expertise so that the entire spectrum of exerciser skill can be accommodated.

It is a further object of this invention to provide a device as characterized above which calls into play the reflexive balancing system intrinsic in the body as signaled by the inner ear so as to stimulate the entire nervous system whereby muscles can contract or relax in reciprocation in order to maintain and regain balance during the course of the exercise.

A specific object provides a body balance board having an upper portion with a fulcrum pivotally attached to a bottom surface thereof so the the fulcrum can rotate in a full 360° range and vary the axis of rocking of the upper portion, and a lower portion placed beneath the upper portion to vary the range of rocking.

Another object has the fulcrum attached to a bottom surface of the upper portion via a pivot pin disposed substantially at the center bottom surface of the upper portion for stability.

Another object is achieved when the lower portion underlies the upper portion and alters the degree of rocking motion obtainable through the upper portion and fulcrum alone.

The previous object can be accented when the lower portion is embodied as a rectangular mass having an upper surface provided with first and second troughs oriented in a substantially cruciform shape, with the first trough having a greater depth than the second trough whereby corners of the lower portion form upwardly extending mesas and the fulcrum, when placed in either of the first or second troughs will thereby alter the rocking motion due to displacement of the upper portion further from the ground supporting surface.

The last named object can be enhanced when the fulcrum is embodied as a substantially elongate cylindrical rod member having a side wall truncated forming a planar surface parallel to but radially offset from a diametral plane, and having the planar surface placed in pivotal registry with a bottom surface of the upper portion.

Alternatively, the fulcrum can be formed from an elongate cylindrical rod member having a side wall which is truncated thereby forming a planar surface parallel to a diametral plane but radially offset therefrom, and placing the flat portion opposite from the upper portion so that an arcuate surface of the cylindrical rod member is pivoted to a bottom surface of the upper portion via a flexible pivot including a downwardly extending threaded screw having an enlarged head passing through the upper portion and adapted to coact with a sleeve having an internal thread pitch complimental to the threaded screw stem, the sleeve encased in a downwardly extending cylindrical elastomeric material having an enlarged head passing through the rod whereby articulation occurs about the elastomeric.

A method of exercising is also an object and includes the steps of: taking a balancing board upper portion and orienting an underlying fulcrum to selectively vary the axis of rocking of said upper portion and placing an underlying lower portion strategically adjacent the upper portion to alter the range of rocking either beneath a leading edge, a trailing edge, or the fulcrum. By providing the lower portion with a cruciform shaped trough with first and second different depths, orienting the trough depth immediately underlying the fulcrum alters the degree of rocking possible. By placing a foot on a top surface of the upper portion, rocking first in one direction about the preselected axis of rotation holding that one extreme position preferrably until the body has regained balance but at least for a pre-determined interval such as ten seconds, one will benefit.

Viewed in another aspect, the present invention constitutes an exercise device intended to correlate the reflexes of a person using the device. The device includes a first portion having a top surface adapted to be supported by only foot of the person using the device. A second portion is disposed below the first portion and is adapted to rest upon the floor, and a third portion is disposed between the first and second portions. Means are provided for pivoting the third portion to the first portion about a vertical axis, such that the first portion may be pivoted relative to the third portion and in a horizontal plane to an adjusted alternate position prior to use of the exercise device; and means are provided, associated with the third portion, for accommodating a limited rocking movement of the first portion with respect to the second portion about a horizontal axis and in a vertical plane.

Viewed in yet another aspect, the present invention constitutes an exercise intended to correlate the reflexes of a person using the device, wherein a first portion in the form of an elongated board has a top surface adapted to be supported by only one foot of the person using the device. A second portion is disposed below the board and is adapted to rest upon the floor. A third portion comprises a substantially cylindrical member disposed between the first and second portions and adapted to be supported upon the second portion. This member has a substantially flat truncated portion in contact with one of the first and second portions; and this member is arranged substantially transversely of the first portion, such that the first portion may have a limited rocking movement with respect to the second portion about a horizontal axis and in a vertical plane. Means are then provided for pivotably adjusting the position of the first portion about a vertical axis and with respect to the member prior to use of the device.

These and other objects will be made manifest when considering the following detailed specifications when taken in conjunction with the appended drawing figures.

BRIEF DESCRIPTION OF THE DRAWING FIGURES

DESCRIPTION OF THE PREFERRED EMBODIMENT

Figure 1:
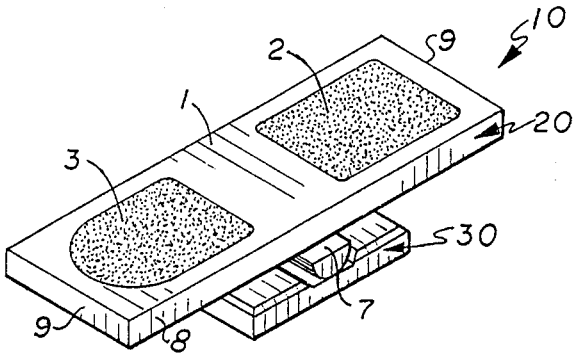
FIG. 1 is a perspective view of the apparatus according to the present invention.
Figure 2:
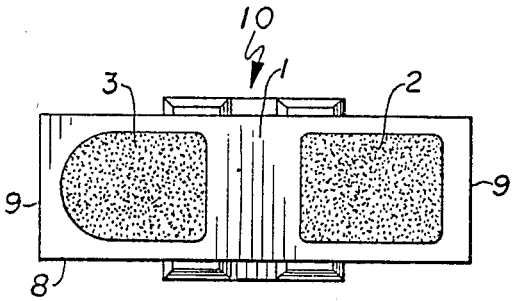
FIG. 2 is a top plan view thereof.

Referring to the drawings now, wherein like reference numerals refer to like parts throughout the various drawing figures, reference numeral 10 is directed to the body balance board according to the present invention. The board 10 is formed from two components: an upper (or first) portion 20 and a lower portion 30.

The upper portion 20 is formed as a blank of rectangular stock material, preferably formed from a hard wood, and includes a top wall 1, a bottom wall 4, a pair of side walls 8 and end walls 9. The top wall 1 of the upper portion 20 includes two textured surfaces 2 and 3 to respectively accommodate the sole and heel portions of a person's foot. It is contemplated that one using this device will not be wearing shoes.

The bottom wall 4 of the upper portion 20 includes a third portion preferably constituting a substantially-cylindrical rod member 5 having an arcuate bottom surface and planar top surface 5 pivoted to a geometrical center of the upper portion bottom wall 4 through pivot 6. The pivot 6 and areas outboard of the pivot along the axis of rotation are provided with traction enhancing devices such as rubber plugs, along the arcuate bottom surface thereof.

The lower portion 30 is formed as a substantially square blank preferably formed of a hard wood and has a top surface 21 and a bottom surface 22.

Figure 6:
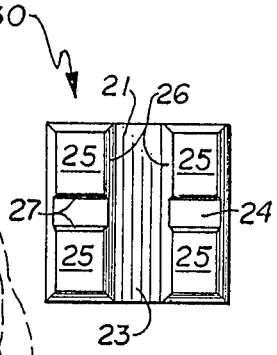
FIG. 6 is a top plan view of that which is shown in FIG. 4.
Figure 7:
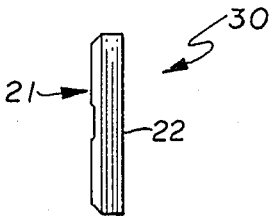
FIG. 7 is another end view from that which is shown in FIG. 4.

The top surface 21 includes a first trough 23 and a second trough 24, disposed at right angles to each other, each trough respectively centered to intersect at the center of the square blank. The trough 23 has a greater depth than the trough 24 and therefore is the "overriding" trough at the geometrical center. Thus, a cruciform-shaped trough is provided which as shown in FIG. 6 has a vertical trough of greater depth than horizontal trough, and four mesas 25 are thereby formed in quadrants immediately adjacent to corners of the blank.

Figure 8:
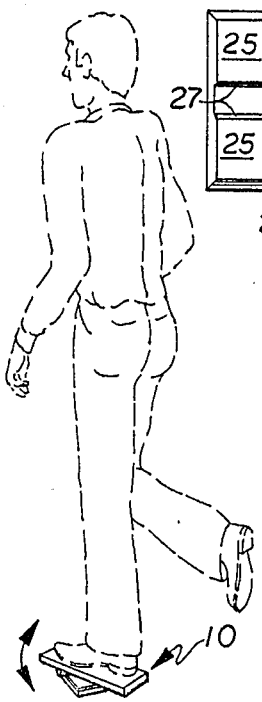
FIG. 8 shows one using the apparatus according to the present invention.

In use and operation, a multiplicity of orientations of the first and second portions can be effected to accommodate a spectrum of users. FIG. 8 is illustrative of merely one method of utilization of the device.

In the most elemental form, for disabled or geriatric patients, for people of minimal balancing and reflexive capabilities, the upper portion 20 is oriented with respect to the lower portion such that the lower portion 30 is adjacent the leading edge 9 of the upper portion. With the longitudinal axis of the rotatable rod member 5 transverse to the longitudinal axis of the upper portion 20, and the second portion 30 immediately underlying the leading edge 9 of the upper portion 20, a very gentle rocking motion having a minimal displacement will be afforded. A person putting one's heel on the heel tractive surface 3 and the ball of the foot on the tractive surface 2 will get minimal rocking. For initialization, the other foot can be on the ground but eventually will be lifted off the ground so that the entire weight of the person is supported on one foot. This rocking, first in one direction and holding that position for a period of time and preferably until one is balanced will cause a balanced contraction and relaxing of muscles along the length of the person's body as dictated by the imbalance noted by one's inner ear which is related to the brain and therefore to the central nervous system. For example, toe down, regain balance and/or count to ten. Then heel down, regain balance and/or count to ten, etc.

A second orientation of the exercise contemplates providing the first portion 20 alone without the second portion 30 so that the degree of rotation about the axis of rod member 5 is greater by not having the second portion serve as a stop.

A third orientation of the exercise contemplates placing the device as shown in FIG. 1 with the second portion 30 underlying the first portion 20 for even greater rotation. As should be evident, the trough selected to address the rod 5 determines the magnitude of the rocking afforded by the first portion 30. Thus, two further increments in the adjustment can be provided by first using trough 23 in contact with the rotating member 5 and second, for more profound angulation, utilizing the trough 24.

Figure 5:
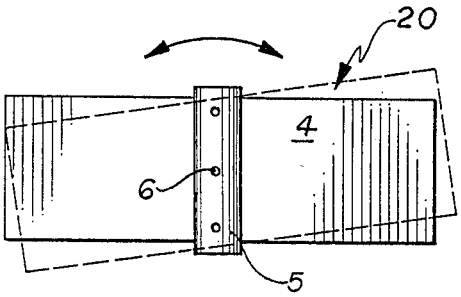
FIG. 5 is a bottom view of that which is shown in FIG. 3, the broken lines indicating the manner in which the first portion may be pivoted into an alternate adjusted position, prior to use of the exercise device.

The device, however, is not limited to rotation which is transverse to the upper portion's longitudinal axis. As shown in FIG. 5, the rod 5 is adapted to rotate through a range of 360° and, as suggested in FIG. 8, the rod 5 may be skewed in such a manner that the rotation induced by the exercise is along a diagonal, for example, from the big toe of the user to the outer heel area or conversely from the little toe of the user to an inboard portion of the heel.

Surprisingly, that which seems like a minimal but controlled rocking motion can provide profound exercise to even the most well conditioned athlete. The process of muscular contraction and relaxation operating in opposed pairs extends throughout the entire length of one's body and by orienting the rod 5 in an appropriate manner, the entire spectrum of muscles can be worked in comfort which is particularly beneficial when certain muscle groups need specific care, for example for rehabilitation or for toning muscles to accommodate for lower back pain, etc.

Figure 3:
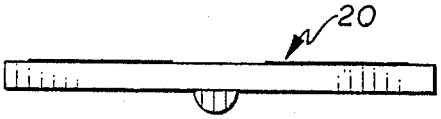
FIG. 3 is a side view of the first component or portion according to the present invention.
Figure 4:
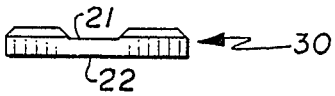
FIG. 4 is an end view of the second or portion component.
Figure 9:
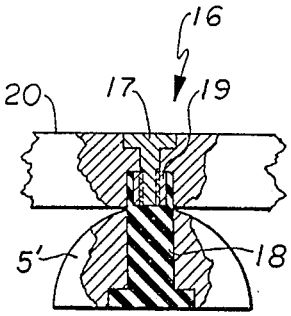
FIG. 9 is an alternative embodiment to FIG. 3 partially in section.

FIG. 9 shows a further form of the invention with respect to structure which diverges from the preceeding. Here the arcuate rod 5' is inverted (c.f. FIG. 3 e.g.) with respect to the first portion 20 and is attached thereto by a modified pivot 16. As shown, a metal screw 17 having an enlarged head passes through and is countersunk in the first portion 20. A metal threaded female bore 19 is carried in a rubber sheath 18 including a cylindrical section and enlarged head which passes through rod 5'. This allows rocking where 20 and 5' connect.

Moreover, having thus described the invention it should be apparent that numerous structural modifications are contemplated as being a part of this invention as set forth herein above and defined herein below as the claims.

What is claimed is:

1. A device for concomitantly correlating cerebral, neural and muscular reflexes comprising in combination:

an upper portion means having a top surface dimensioned to address and receive the plantar portion of a person's foot, a substantially cylindrical fulcrum means positioned substantially transversely of the upper portion means and coacting against a bottom surface of said upper portion means along a central area thereof, whereby a horizontal axis of rocking is provided to allow a rocking motion of said upper portion means about said fulcrum means, and means to variably orient said fulcrum means with respect to said upper portion means about a vertical axis in a horizontal plane to vary the axis of rocking of said upper portion means about said fulcrum means; wherein said fulcrum means is attached to a bottom surface of said upper portion means via a vertical pivot pin disposed substantially at the center of the bottom surface of said upper portion means.

2. The device of claim 1, wherein a lower base portion underlies said upper portion means and alters the degree of rocking motion obtainable through said upper portion means and fulcrum means alone.

3. A device for concomitantly correlating cerebral, neural and muscular reflexes comprising in combination:

an upper portion means having a top surface dimensioned to address and receive the plantar portion of a person's foot, fulcrum means coacting against a bottom surface of the upper portion means along a central area thereof, to allow a rocking motion of the upper portion means and about the fulcrum means, and means to variably orient to the fulcrum means with respect to the upper portion means to vary the axis the axis of rocking of the upper portion means about the fulcrum means, wherein the fulcrum means is attached to a bottom surface of said upper portion means via a pivot pin disposed substantially at the center of the bottom surface of the upper portion means, wherein a lower base portion underlies the upper portion means and alters the degree of rocking motion obtainable through the upper portion means and fulcrum means alone, and wherein the lower portion is embodied as a rectangular mass having an upper surface provided with first and second troughs oriented thereon in a substantially cruciform shape, the first trough having a greater depth than the second trough, whereby corners of the lower portion form upwardly extending mesas and the fulcrum means when placed in either of the said first or second troughs will thereby alter the rocking motion due to displacement of the upper portion means further from the ground supporting surface.

4. The device of claim 3, wherein said fulcrum means is embodied as a substantially elongate cylindrical rod member having one portion of a side wall truncated, thereby forming a planar surface parallel to but radially offset from a diametral plane, said flat portion placed in pivotal registry with a bottom surface of said upper portion means.

5. The device of claim 3, wherein said fulcrum means is formed from an elongate cylindrical rod member having one portion of a side wall truncated, thereby forming a planar surface parallel to a diametral disposed plane but radially offset therefrom, said flat portion placed diametrically opposed from said upper portion means, and an arcuate surface of said cylindrical rod member pivoted to a bottom surface of said upper portion means via a flexible pivot including a downwardly extending threaded screw having an enlarged head passing through said upper portion means adapted to coact with a sleeve having an internal thread pitch complemental to said threaded screw stem, said sleeve encased in a downwardly extending cylindrical elastomeric material having an enlarged head fixed in said rod, whereby articulation occurs about said cylindrical elastomeric material located where said rod and upper portion meet.

6. A body balance board comprising in combination:

an upper portion means having a substantially cylindrical fulcrum means positioned substantially transversely of the upper portion, whereby a horizontal axis of rocking is provided and pivotally attached to a bottom surface thereof, so that said fulcrum means can rotate about a vertical axis in a horizontal plane in a full 360° range to vary the axis of rocking of said upper portion means about the fulcrum means, and a lower base portion placed beneath said upper portion means to vary the range of rocking.

7. A body balance board comprising in combination:

an upper portion means having a fulcrum means pivotally attached to a bottom surface thereof, so that said fulcrum means can rotate in a full 360° range and vary the axis of rocking of said upper portion, and a lower base portion placed beneath said upper portion means to vary the range of rocking, wherein said fulcrum means is attached to a bottom surface of said upper portion means via a pivot pin disposed substantially at the center bottom surface of said upper portion means, and wherein the lower portion is embodied as a rectangular mass having an upper surface provided with first and second troughs oriented thereon in a substantially cruciform shape, the first trough having a greater depth than the second trough, whereby corners of the lower portion form upwardly extending mesas, and the fulcrum means when placed in either of the the first of second troughs will thereby alter the rocking motion due to displacement of the upper portion means further from the ground supporting surface.

8. The device of claim 7, wherein said fulcrum is embodied as a substantially elongate cylindrical rod member having one portion of a side wall truncated, thereby forming a planar surface parallel to but radially offset from a diametral plane, said flat portion placed in pivotal registry with a bottom surface of said upper portion means.

9. The device of claim 7, wherein said fulcrum means is formed from an elongated cylindrical rod member having one portion of a side wall truncated, thereby forming a planar surface parallel to a diametral plane radially offset therefrom, said flat portion placed diametrically opposed from said upper portion means, and an arcuate surface of said cylindrical rod member pivoted to a bottom surface of said upper portion means via a flexible pivot including a downwardly extending threaded screw having an enlarged head passing through said upper portion means adapted to coact with a sleeve having an internal thread pitch complemental to said threaded screw stem, said sleeve encased in a downwardly extended cylindrical elastomeric material having an enlarged head fixed in said rod, whereby articulation occurs about said cylindrical elastomeric material located where said rod and upper portion meet.

10. A method of exercise including the steps of:

taking a balancing board upper portion and variably orienting an underlying substantially cylindrical fulcrum about a vertical axis in a horizontal plane with respect to the upper portion to selectively vary the axis of rocking of said upper portion about the fulcrum, including placing an underlying lower base portion strategically adjacent said upper portion substantially transversely thereof to alter the range of rocking, further providing the lower portion with a cruciform shaped trough having first and second troughs of different depths, the method of exercise including placing a foot on a top surface of said upper portion and rocking and holding an extreme position and for a time interval about a pre-selected axis of rotation while initially benefitting by balancing with the other foot on a suitable surface.

11. The method of claim 10, including placing said lower portion immediately beneath a leading edge of said upper portion.

12. The method of claim 10, including the step of placing the lower portion immediately adjacent and underlying a trailing edge of said upper portion.

13. The method of claim 12, including the step of orienting the lesser depth trough immediately underlying the fulcrum.

14. The method of claim 12, including the step of placing the greater depth trough in registry immediately underlying the fulcrum.

15. An exercise device intended to correlate the reflexes of a person using the device, comprising a first portion having a top surface adapted to support only one foot of the person using the device, a second portion disposed below the first portion and adapted to rest upon the floor, a substantially cylindrical third portion disposed between the first and second portions such that the first portion has a limiting rocking movement with respect to the second portion about a horizontal axis of rocking with respect to the third portion, vertical pin means pivoting the third portion to the first portion about a vertical axis, such that the first portion may be pivoted relative to the third position about the vertical axis and in a horizontal plane to an alternate position prior to use of the exercise device, thereby varying the axis of rocking of the first portion relative to the third portion, and means associated with the second portion for varying the degree of rocking movement of the first portion with respect to the second portion about the horizontal axis and in a vertical plane.

16. An exercise device intended to correlate the reflexes of a person using the device, comprising a first portion in the form of an elongated board having a top surface adapted to support only one foot of the person using the device, a second portion disposed below the board and adapted to rest upon the floor, a third portion comprising a substantially cylindrical member disposed between the first and second portions and adapted to be supported upon the second portion, the member having a substantially flat truncated portion in contact with one of the first and second portions, the member being arranged substantially transversely of the first portion, whereby the first portion may have a limited rocking movement with respect to the second portion about a horizontal axis and in a vertical plane, and vertical pin means for pivoting the position of the first portion about a vertical axis in a horizontal plane with respect to the member prior to use of the device, whereby the horizontal axis about which the first portion rocks may be varied.

* * * * *